United States Patent [19]

Haytayan

[11] Patent Number: 5,016,802

[45] Date of Patent: May 21, 1991

[54] EXPLOSIVE ACTUATED EXTENDABLE DRIVING TOOL

[76] Inventor: Harry M. Haytayan, 32 Indian Rock Rd., Nashua, N.H. 03063

[21] Appl. No.: 476,121

[22] Filed: Feb. 2, 1990

Related U.S. Application Data

[63] Continuation of Ser. No. 273,988, Nov. 21, 1988, abandoned.

[51] Int. Cl.[5] ..... B25C 1/18

[52] U.S. Cl. ..... 227/11; 227/9; 173/DIG. 2

[58] Field of Search ..... 227/9, 10, 11, 147; 173/DIG. 2

[56] References Cited

U.S. PATENT DOCUMENTS

| | | | |
|---|---|---|---|
| 2,700,764 | 2/1955 | Catlin et al. | 227/11 |
| 2,747,187 | 5/1956 | Catlin et al. | 227/11 |
| 2,932,031 | 4/1960 | Reymond | 227/11 |
| 3,248,032 | 4/1966 | Bochman, Jr. | 227/11 X |
| 3,407,982 | 10/1968 | Henning | 227/9 |
| 3,606,129 | 9/1971 | Ritter | 227/11 |
| 3,665,583 | 5/1972 | Helderman | 227/10 |
| 3,797,721 | 3/1974 | Clumb | 227/9 |
| 3,949,922 | 4/1976 | Hodil | 227/10 |
| 4,446,999 | 5/1984 | Benson et al. | 227/11 |
| 4,655,380 | 4/1987 | Haytayan | 227/9 |

*Primary Examiner*—Frank T. Yost
*Assistant Examiner*—Rinaldi Rada
*Attorney, Agent, or Firm*—Pandiscio & Pandiscio

[57] ABSTRACT

An explosive actuated extendable driving tool has a housing with a barrel at its front end for receiving a fastening element that is to be secured in a ceiling, wall or the like. A manually actuated reciprocatable positioner shaft is slidably received in a retainer that is mounted to the back end of the housing, the positioner shaft being biased towards the back end of the housing. A load chamber formed which is in an inner end of the barrel is configured to receive an explosive charge. A muzzle with a self-aligning spall guard and splash guard are mounted to the barrel, the splash guard being disposed about the spall guard. A noise suppression element is contained in a chamber formed between the spall guard and the splash guard. Discharge ports formed in the barrel and spall guard define exits for the discharge of combustion gases and carbon into the noise suppression element. An extendable handle is connected to the back end of the positioner shaft, the handle operating as an actuator for firing the charge and driving the fastening element from the driving tool.

16 Claims, 2 Drawing Sheets

EXPLOSIVE ACTUATED EXTENDABLE DRIVING TOOL

This is a continuation of U.S. Pat. Ser. No. 07/273,988, filed Nov. 21, 1988, now abandoned.

BACKGROUND OF THE INVENTION

1. Field of Invention

The present invention relates to explosive actuated tools and, more particularly, is directed towards explosive actuated tools for driving fastening elements into work surfaces such as ceilings, walls and the like.

2. Description of the Prior Art

A variety of explosive actuated tools for driving fastening elements have been developed over the years. Such tools include those shown in U.S. Pat. Nos. 3,665,583; 3,407,982; 3,797,721; 3,805,472; 4,655,380 and the patents cited therein. Prior art explosive actuated driving tools suffer from several disadvantages and limitations. Generally, explosive actuated driving tools are relatively complex in construction and costly to manufacture. In addition, due to inadequate venting of the combustion chamber, many of these tools suffer from the disadvantages that they are relatively noisy and they tend to jam from a buildup of spent powder. Typically, pole assembly driving tools are not readily adaptable to receive extendable members for increasing the length of the pole assembly Furthermore, pistol type explosive actuated driving tools are not easily adapted to be mounted to a pole assembly for driving fastening elements into ceilings.

SUMMARY OF THE INVENTION

It is an object of the present invention to provide an explosive actuated driving tool which does not suffer from the heretofore mentioned disadvantages and limitations.

Another object of the present invention is to provide an explosive actuated extendable tool for driving a fastening element into a work surface such as a ceiling, wall or the like.

Yet another object of the invention is to provide an explosive actuated driving tool having an extendable handle which operates as a slidable ram for firing an explosive charge.

A further object of the invention is to provide an explosive actuated tool which permits precise positioning of the fastening element against the work surface into which the fastening element is to be driven by an exploding charge.

Yet a further object of the present invention is to provide an explosive actuated driving tool with a self-aligning muzzle and noise suppression element.

An explosive actuated extendable driving tool embodying the invention has a housing with a barrel connected to a front end of the housing for receiving a fastening element that is to be secured in a work surface such as a ceiling, wall or the like. A manually actuated reciprocatable positioner shaft is slidably received in a retainer that is mounted to a back end of the housing, the positioner shaft being biased by a spring towards a back end of the diving tool. An extendable handle is connected to the back end of the positioner shaft. A muzzle with a self-aligning spall guard and a splash guard is mounted to a front end of the barrel, the spall guard being constrained for limited movement relative to the barrel. The splash guard, which is disposed about the spall guard, is constrained for limited movement relative to the spall guard. A noise suppression element is contained in a compartment that is formed between the spall guard and the splash guard. A penetrating tip of the fastening element extends outwardly from the front end of the spall guard, a back or firing end of the fastening element is in contact with an explosive charge that is placed in a load chamber formed in an inner end of the barrel. A washer with a central opening is received and held in a socket formed in a front end of the spall guard, the penetrating tip of the fastening element projecting through the washer opening. Discharge ports formed in the barrel and spall guard define exits for the discharge of combustion gases and carbon into the noise suppression element When the handle is pushed inwardly towards the front or muzzle end of the driving tool, the positioner shaft is urged into contact with the housing. In consequence, the penetrating tip of the fastening element presses against the work surface and the firing end of the fastening element is forced against the explosive charge with sufficient force to set off the charge and drive the fastening element into the work surface, the washer being held against the work surface by the fastener.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
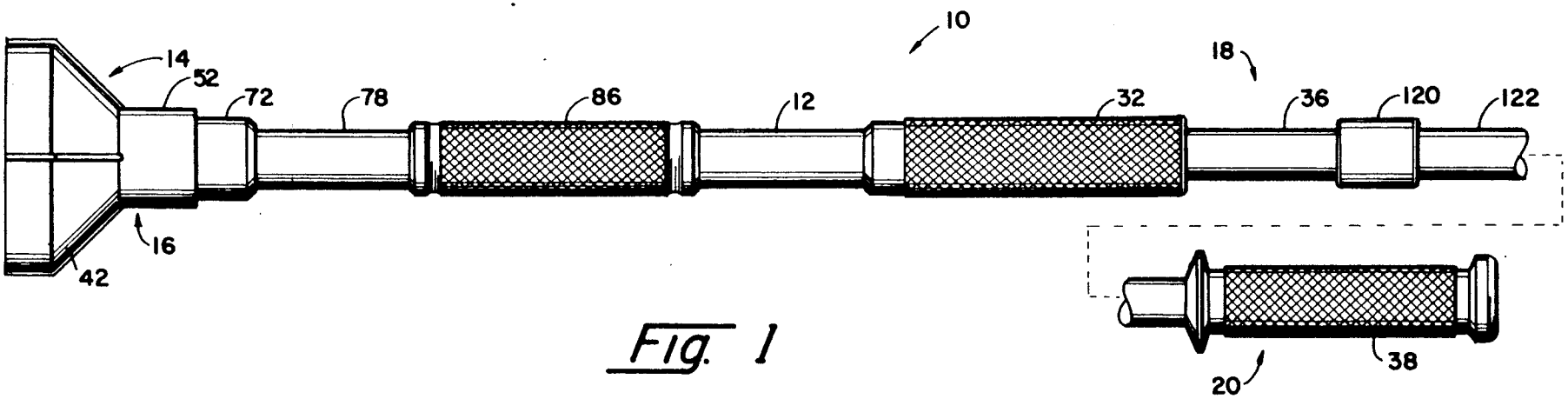
FIG. 1 is a side view of an explosive actuated driving tool embodying the present invention.

Referring now to the drawings, particularly FIG. 1, there is shown an explosive actuated extendable driving tool 10 embodying the present invention. Driving tool 10 comprises a housing 12 having a muzzle 14 at a discharge or front end 16 of the tool and a trigger assembly 18 at a back end 20 of the tool.

Figure 3:
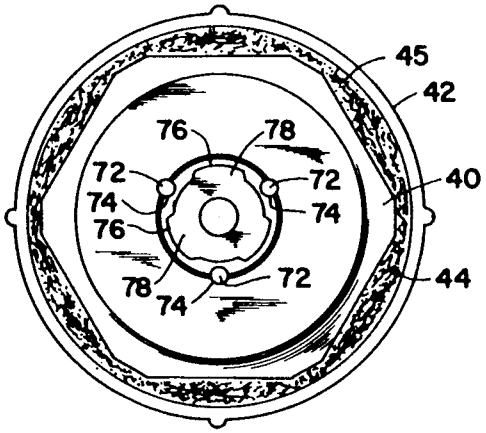
FIG. 3 is a side view in cross-section of the driving tool shown in FIG. 1.
Figure 2:
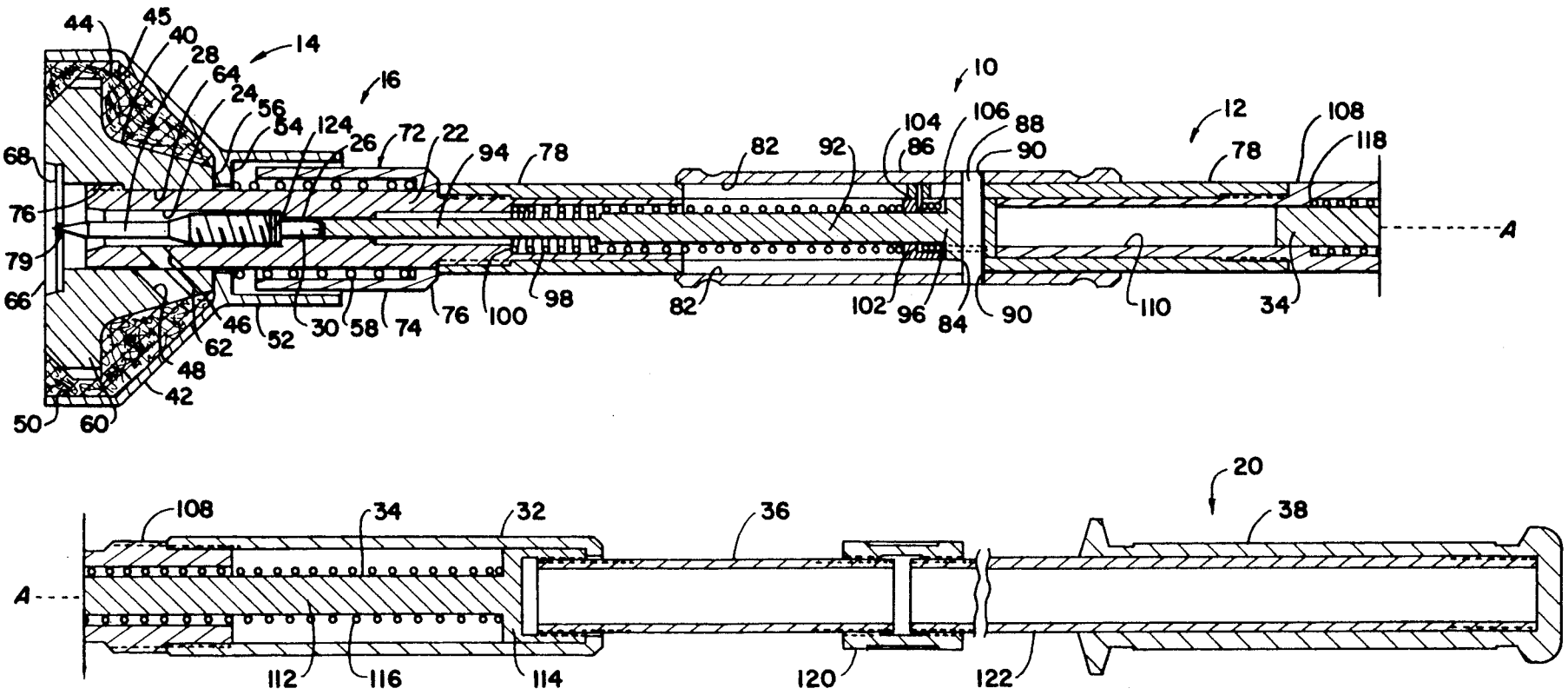
FIG. 2 is an end view of the muzzle of the driving tool shown in FIG. 1.

As best shown in FIG. 3, housing 12 includes a barrel 22 at front end 16. Barrel 22 is formed with a central bore 24 and a load chamber 26. Bore 24 is configured to receive a fastening element 28 that is to be secured to a work surface (not shown), for example, a ceiling, a wall or the like. Load or explosion chamber 26 is configured to receive a percussion explodable charge 30 which is ignited by the trigger assembly 18.

Trigger assembly 18 includes a retainer 32 that is mounted to housing 10 and a positioner shaft 34 which is slidably received in the retainer. A nipple 36 is attached to positioner shaft 34 and a handle 38 is connected to the nipple As hereinafter described, handle 38 is pushed inwardly to ignite charge 30 and propel fastening element 28 out of barrel 22 and muzzle 14 and into the work surface.

Muzzle 14 includes a self-aligning spall guard 40 and a splash guard 42. Spall guard 40 is mounted to a front end of barrel 22, the spall guard being constrained for limited movement relative to the barrel. Splash guard 42, which is disposed about spall guard 40, is constrained for limited movement relative to the spall guard. A noise suppression element 44 is contained in a chamber 45 that is formed between the spall guard 40 and the splash guard 42. Preferably, but not necessarily, noise suppression element 44 consists of metal wire mesh. Discharge ports 46 and 48 formed in barrel 22 and spall guard 40, respectively, define exits for the discharge of combustion gases into noise suppression element 44.

Splash guard 42, which captures fragments from the work surface into which the fastening element 28 is to be driven, for example, a concrete ceiling, is a hollow member having a substantially fustro-conical internal chamber 50 with a wide mouth 51 at its front end and a tubular section 52 at its back end. An internal annular rib or flange 54 is formed at a forward end of tubular section 52, the rib being biased against a rear shoulder 56 of spall guard 40 by a compression spring 58.

Spall guard 40 has a substantially mushroom profile in right cross-section with an enlarged head 60 and a fustro-conical body 62 Spall guard 40 has a central bore 64 with an enlarged socket 66 at its front end. Socket 66 is configured to receive a washer 68 with a central opening 70. A plurality of magnet and sleeve assemblies 72 (FIG. 3) are fitted into holes 74 that are drilled into spall guard 40. Magnet and sleeve assemblies 72 releasably hold washer 68 in socket 66. The tip of fastening element 28 projects through opening 70 when the fastening element is loaded into barrel 22. A plurality of grooves 76 that are formed in the front end of spall guard 40 are configured to receive tongue members 78 that are formed at the front end of barrel 22. The tongue and groove arrangement permits limited longitudinal movement of spall guard 40 relative to barrel 22 while constraining the spall guard against rotational movement relative to the barrel. The play between spall guard 40 and barrel 22 compensates for any uneveness in the work surfaces that the spall guard is pressed against and allows for escape of carbon from the ignition of charge 30 in load chamber 26.

As previously indicated, barrel 22 is formed with central bore 26 and a load chamber 26. A spring housing 79 in the form of a cylindrical sleeve 81 with a shoulder 83 at a back end is slidably fitted over barrel 22. Spring 58 is captively held against lateral movement by barrel 22 and spring housing 79, the ends of spring 58 being in contact with rib 54 and shoulder 83. An ejector tube 80 is slid onto barrel 22, a front end of the ejector tube being in contact with the back end of shoulder 83. Ejector tube 78 is formed with opposed longitudinally extending slide slots 82 and opposed transverse lock slots 84.

A tubular hand grip 86 is slidably received on ejector tube 80. A roll pin 88 is press fitted into opposed holes 90 in hand grip 86, the roll pin passing through transverse lock slots 84. When hand grip 86 is rotated to an unlocked position, roll pin 88 is aligned with longitudinally extending slide slots 82, and the hand grip is free to move longitudinally. When roll pin 88 is positioned in lock slots 84 and out of alignment slide slots 82, hand grip 86 is in its locked position and the hand grip is constrained against longitudinal movement. When hand grip 86 is moved longitudinally, it carries with it an ejector 92 which is slidably received in barrel 22.

Ejector 92 has a narrow front end 94 and an enlarged head 96 at a back end Ejector 92 is constrained for movement between a stored position and an ejecting position for ejecting a spent charge from barrel 22. A compression spring 98 bears against a shoulder 100 in barrel 22 and a torsion spring housing 102. In an alternate embodiment, transverse lock slots 84 are eliminated and compression spring 98 is sufficiently strong that ejector 92 moves longitudinally with longitudinal movement of hand grip 86. A torsion spring roller 104 is attached to torsion spring housing 102. A torsion spring 106 is held between torsion spring housing 102 and ejector head 96.

A positioner housing 108 is attached, for example by threads, to a back end of ejector tube 80. Retainer 32 is attached to a back end of positioner housing 108 by threads, for example. Positioner housing 108 has a bore 110 that is configured to receive positioner shaft 34. Positioner shaft 34 has an elongated narrow body 112 and an enlarged head 114 that is internally threaded for interconnecting with nipple 36. A compression spring 116 is constrained between a shoulder 118 of positioner housing 108 and enlarged head 114. A coupling 120 is turned onto a threaded back end of nipple 36 and a front threaded end of a nipple 122 is turned into coupling 120. Handle 38 is attached to nipple 122. Although two connected nipples 36 and 122 are shown, it is to be understood that in other embodiments the number of nipples is other than two, for example one or three or four or some other number. The number of nipples is determined by the desired length of tool 10.

In operation of driving tool 10, a charge 30 is positioned in load chamber 26. Next, a fastening element 28 is placed in bore 24, the fastening element having a ridged head 124 that rests against charge 30. The tip of fastening element 28 projects outwardly of bore 24. Washer 68 is placed over the projecting tip of fastening element 28, the washer being held in socket 66 by magnet and sleeve assemblies 72. Next, spall guard 40 and splash guard 42 are placed against a work surface into which fastening element is to be driven, tool 10 being pushed against the work surface by nipple 36 or handle 38. Next, handle 38 is rapidly pushed toward muzzle 14. This rapid movement of handle 38 causes positioner shaft 34 to strike positioner housing 108. Positioner housing 108, ejector tube 80, spring housing 79, spall guard 40 and splash guard 42 are interconnected in such a manner as to provide a rigid structure. The force exerted by handle 38 on positioner housing 108 via positioner shaft 34 is transmitted to spall guard 40, which in turn is forced backward by fastening element 28 and washer 68. The backward movement of fastening element 28 drives ridged head 124 of the fastening element into the charge 30. The charge is ignited and fastening element 28 is fired into the work surface, washer 68 being pressed against the work surface. Discharge gases resulting from the firing of charge 30 escape through ports 46 and 48 into noise suppression element 44.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A manually actuated extendable driving tool for driving a fastening element into a work surface by an explosive charge, said tool comprising:

(a) a housing;

(b) a retainer mounted to a back end of said housing;

(c) a barrel connected to a front end of said housing, said barrel formed with a bore, an explosion chamber at an inner end of said bore, said explosion chamber configured to receive an explosive charge, said bore sized to receive a fastening element;

(d) self-aligning muzzle means mounted to said front end of said housing and constrained for limited movement relative to said barrel to compensate for any unevenness in the work surface into which the fastening element is to be driven, a front end of said self-aligning muzzle means configured to press against the work surface, said self-aligning muzzle means being biased towards a front end of the driving tool, a tip of the fastening element projecting outwardly from said bore when the fastening element is received in said bore, said muzzle means including a spall guard and a splash guard, said spall guard mounted to said housing and constrained for limited movement relative to said barrel, said splash guard disposed about said spall guard and constrained for limited movement relative thereto; and (e) trigger means slidably received in said retainer, said trigger means constrained for limited longitudinal movement relative to said barrel, said trigger means biased rearwardly towards said back end of said housing;

(f) the fastening element is driven from the driving tool when (1) the tip of the fastening means is pressed against the work surface and (2) said trigger means is driven towards the front end of the driving tool so as to cause the fastening element to be driven backwards into the explosive charge with sufficient force to ignite the explosive charge.

2. A manually actuated extendable driving tool for driving a fastening element into a work surface by an explosive charge, said tool comprising:

(a) a housing;

(b) a retainer mounted to a back end of said housing;

(c) a barrel connected to a front end of said housing, said barrel formed with a bore having an explosion chamber at an inner end thereof, said explosion chamber configured to receive an explosive charge, said bore sized to receive a fastening element;

(d) manually actuatable positioner shaft means slidably received in said retainer, said positioner shaft means being biased towards a back end of the driving tool;

(e) extendable means connected to a back end of said positioner shaft means for driving said positioner shaft means in a longitudinal direction towards a front end of the driving tool; and (f) self-aligning muzzle means mounted to said front end of said housing and constrained for limited movement relative to said barrel to compensate to any unevenness in the work surface into which the fastening element is to be driven, a front end of said self-aligning muzzle means configured to press against the work surface, said self-aligning muzzle means being biased forwardly toward a front end of the driving tool, a tip of the fastening element projecting outwardly from said bore when the fastening element is received in said bore, said muzzle means including a spall guard and a splash guard, said spall guard mounted to said housing and constrained for limited movement relative to said barrel, said splash guard disposed about said spall guard and constrained for limited movement relative thereto;

(g) the fastening element is propelled from the driving tool when the tip of the fastening means is pressed against the working surface and said extendable means is driven towards the front end of the driving tool, said positioner shaft means moves forward and the fastening element is driven backwards into contact with the explosive charge with sufficient force to ignite the explosive charge.

3. A manually actuated driving tool for driving a fastening element by an explosive charge, said tool comprising:

(a) a housing;

(b) a retainer mounted to a rearward portion of said housing;

(c) a manually actuated reciprocatable positioner shaft slidably mounted in said retainer, said positioner shaft being biased towards said rear portion of the driving tool;

(d) a barrel connected to a front portion of said housing, said barrel formed with a bore that is configured to receive a fastening element;

(e) a load chamber formed in said barrel, said load chamber configured to receive a percussion explodable charge;

(f) a self-aligning spall guard mounted to said housing at a forward portion thereof, said spall guard constrained for limited movement relative to said barrel;

(g) a splash guard disposed about said spall guard, said splash guard constrained for limited movement relative to said spall guard, an exit chamber formed between said spall guard and said splash guard;

(h) a noise suppression element disposed in said exit chamber;

(i) at least one discharge port formed in said barrel and said spall guard said discharge port communicating with said bore and said exit chamber, said discharge port defining an exit for the release of combustion gases and carbon from said load chamber into said noise suppression element after ignition of the charge;

(j) a handle connected to a back end of said positioner shaft and constrained for limited movement towards a front end of said housing, the fastening element being driven from said barrel when said handle is driven towards a front end of the driving tool, the positioner shaft moves forwardly and the fastening element is driven backwards into contact with the charge with sufficient force to ignite the charge.

4. The manually actuated driving tool as claimed in claim 3 including connector means attached to a back end of said handle, said connector means configured to connect at least one extension handle to said handle for increasing the overall length of the driving tool.

5. A manually actuated extendable driving tool for driving a fastening element into a work surface by ana explosive charge, said tool comprising:

(a) a housing;

(b) a retainer mounted to a back end of said housing;

(c) a barrel connected to a front end of said housing, said barrel formed with a bore and an explosion chamber at an inner end of said bore, said explosion chamber configured to receive an explosive charge, said bore sized to receive a fastening element;

(d) muzzle means mounted to said front end of said housing, a tip of the fastening element projecting outwardly from said bore when said fastening element is received in said bore, said muzzle means including a self-aligning spall guard mounted to said housing, said spall guard constrained for limited movement relative to said barrel, and a splash guard disposed about said spall guard, said splash guard constrained for limited movement relative to said spall guard, an exit chamber formed between said spall guard and said splash guard; and (e) trigger means slidably received in said retainer, said trigger means constrained for limited longitudinal movement relative to said barrel, said trigger means biased towards said back end of said housing;

(f) the fastening element is driven from the driving tool when (1) the tip of the fastening means is pressed against the work surface and (2) said trigger means is driven towards the front end of the driving tool so as to cause the fastening element to be driven backwards into the explosive charge with sufficient force to ignite the explosive charge.

6. The manually actuated extendable driving tool as claimed in claim 5 wherein said muzzle means is formed with a socket that is configured to receive a washer, said bore extending through said socket.

7. The manually actuated extendable driving tool as claimed in claim 6 wherein said muzzle means includes holding means for releasably holding the washer in said socket.

8. The manually actuated extendable driving tool as claimed in claim 5 including a noise suppression element contained in said exit chamber formed between said spall guard and said splash guard.

9. The manually actuated extendable driving tool as claimed in claim 8 wherein at least one discharge port is formed in said barrel and spall guard, said discharge port communicating with said bore and said exit chamber, said discharge port defining an exit for the release of combustion gases and carbon from said explosion chamber into said noise suppression element after ignition of the charge.

10. The manually actuated extendable driving tool as claimed in claim 9 wherein said trigger means includes:

(a) an actuated reciprocatable positioner shaft slidably mounted in said retainer, said positioner shaft being biased towards said rear end of the diving tool; and (b) an extendable handle connected to a back end of said positioner shaft, said handle constrained for limited movement towards said front end of said housing, the fastening element being driven from said barrel when said handle drives said positioner shaft towards said front end of the driving tool and causes the fastening element to contact the explosive charge with sufficient force to ignite the charge.

11. A manually actuated extendable driving tool for driving a fastening element into a work surface by an explosive charge, said tool comprising:

(a) a housing:

(b) a retainer mounted to a back end of said housing;

(c) a barrel connected to a front end of said housing, said barrel formed with a bore having an explosion chamber at an inner end thereof, said explosion chamber configured to receive an explosive charge, said bore sized to receive a fastening element;

(d) manually actuatable positioner shaft means slidably received in said retainer, said positioner shaft means being biased towards a back end of the driving tool;

(e) extendable means connected to a back end of said positioner shaft means for driving said positioner shaft means in a longitudinal direction towards a front end of the driving tool; and (f) muzzle means mounted to said front end of said housing, a tip of the fastening element projecting outwardly from said bore when the fastening element is received in said barrel, said muzzle means including a self-aligning spall guard mounted to said housing, said spall guard constrained for limited movement relative to said barrel, and a splash guard disposed about said spall guard, said splash guard constrained for limited movement relative to said spall guard, an exit chamber formed between said spall guard and said splash guard;

(g) the fastening element is propelled from the driving tool when (1) the tip of the fastening means is pressed against the working surface, and (2) said extendable means is driven towards the front end of the tool, and (3) said positioner shaft means is driven forward so as to cause the fastening element to be driven backwards into the explosive charge with sufficient force to ignite the explosive charge.

12. The manually actuated extendable driving tool as claimed in claim 11 including a noise suppression disposed in said exit chamber.

13. The manually actuated extendable driving tool as claimed in claim 12 wherein at least one discharge port is formed in said barrel and said spall guard, said discharge port communicating with said bore and said exit chamber, said discharge port defining an exit for the release of combustion gases and carbon from said explosion chamber into said noise suppression element after ignition of the charge.

14. The manually actuated extendable driving tool as claimed in claim 13 wherein said extendable means is a handle connected to the back end of said positioner shaft, said handle having connector means which is configured to receive at least one additional handle for increasing the overall length of the driving tool.

15. A manually actuated driving tool for driving a fastening element into a work surface by an explosive charge, said tool comprising:

(a) a housing;

(b) retainer means mounted to a back end of said housing;

(c) a barrel connected to a front end of said housing, said barrel formed with a bore, an explosion chamber at an inner end of said bore, said explosion chamber configured to receive an explosive charge, said bore sized to receive a fastening element, a tip of the fastening element projecting outwardly from said bore when the fastening element is received in said bore, (d) muzzle means mounted to said barrel and constrained for limited movement relative thereto, a portion of said muzzle means sized to permit play between said muzzle means and said barrel, said muzzle means including a spall guard and a splash guard, said spall guard mounted to said housing and constrained for limited movement relative to said barrel, said splash guard disposed about said spall guard and constrained for limited movement relative thereto;

(e) means limiting forward movement of said muzzle means relative to said barrel;

(f) bias means urging said muzzle means towards a front end of the driving tool and away from said retainer means; and (g) trigger means slidably received in said retainer, said trigger means constrained for limited longitudinal movement relative to said barrel, said trigger means biased towards said back end of said housing;

(h) the fastening element is driven from the driving tool when (1) the tip of the fastening means is pressed against the work surface and (2) said trigger means is driven towards the front end of the driving tool so as to cause the fastening element to be driven backwards into the explosive charge with sufficient force to ignite the explosive charge.

16. The driving tool as claimed in claim 15 wherein said bias means is a spring.

* * * * *

UNITED STATES PATENT AND TRADEMARK OFFICE

CERTIFICATE OF CORRECTION

PATENT NO. : 5,016,802

DATED : May 21, 1991

INVENTOR(S) : Harry M. Haytayan

It is certified that error appears in the above-identified patent and that said Letters Patent is hereby corrected as shown below:

Claim 5, col. 6, line 66, the term "ana" should be changed to the word -- an --; and Claim 10, col. 7, line 53, delete the word "an" and before the word "actuated", insert the words -- a manually --.

Signed and Sealed this

Twenty-second Day of September, 1992

*Attest:*

DOUGLAS B. COMER

*Attesting Officer*

*Acting Commissioner of Patents and Trademarks*